US006021632A

United States Patent [19]

König

[11] Patent Number: 6,021,632

[45] Date of Patent: Feb. 8, 2000

[54] DEVICE FOR PRODUCING THICK AND THIN EFFECTS IN A FILAMENT YARN

[75] Inventor: Günter König, Uhingen, Germany

[73] Assignee: Zinser Textilmaschinen GmbH, Ebersbach/Fils, Germany

[21] Appl. No.: 09/011,679

[22] PCT Filed: Apr. 22, 1997

[86] PCT No.: PCT/DE97/00809

§ 371 Date: Feb. 12, 1998

§ 102(e) Date: Feb. 12, 1998

[87] PCT Pub. No.: WO98/00588

PCT Pub. Date: Jan. 8, 1998

[30] Foreign Application Priority Data

Jun. 28, 1996 [DE] Germany ..... 196 62 032

[51] Int. Cl.[7] ..... D01H 7/46

[52] U.S. Cl. ..... 57/290; 28/240; 28/243; 28/245; 57/287; 57/288

[58] Field of Search ..... 28/240, 243, 245; 57/3, 6, 10, 17, 18, 284, 287, 288, 289, 290

[56] References Cited

U.S. PATENT DOCUMENTS

| | | | |
|---|---|---|---|
| 3,949,041 | 4/1976 | Schwarz | 264/168 |
| 5,760,374 | 6/1998 | Schippers et al. | 57/284 |
| 5,822,971 | 10/1998 | Bauer | 57/284 |
| 5,836,146 | 11/1998 | Konig | 57/287 |

FOREIGN PATENT DOCUMENTS

| | | |
|---|---|---|
| 33 46 677 A1 | 7/1985 | Germany . |
| 38 41 525 A1 | 6/1990 | Germany . |

*Primary Examiner*—William Stryjewski
*Attorney, Agent, or Firm*—Herbert Dubno

[57] ABSTRACT

An apparatus for producing thick/thin effects in a filament yarn, whereby between inlet and outlet gallets or pairs of pinch rollers, in a stretching zone, the filament yarn contacts the periphery of at least one rotating disk which is heated and is formed with at least one region of reduced radius in which there is no contact between the filament yarn and the disk. The filament yarn is thereby stretched only in regions in which it is heated by contact with the disk periphery and remains thick in those regions in which it is unheated because of the presence of the recess.

12 Claims, 1 Drawing Sheet

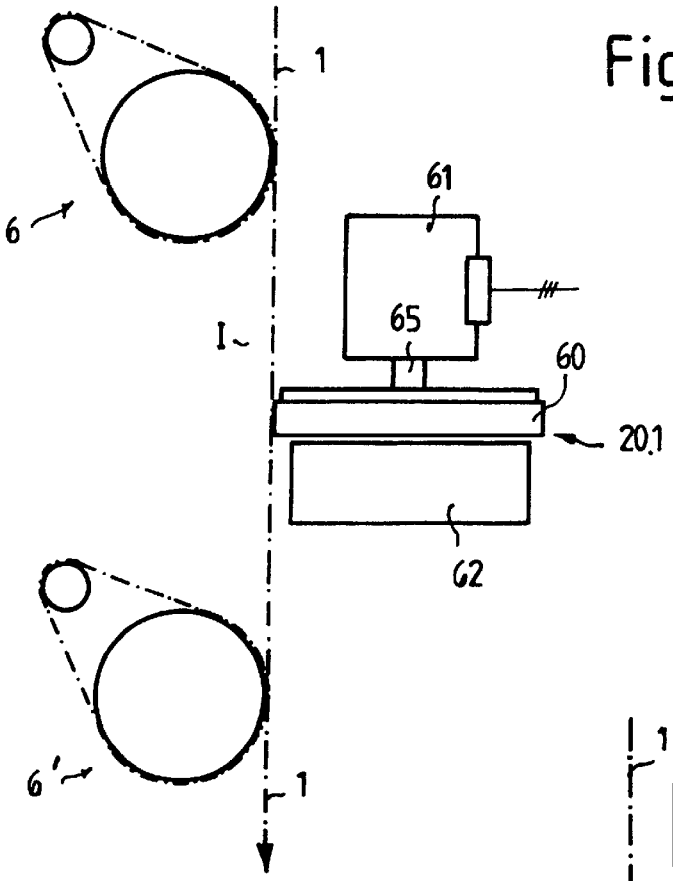
Fig.1
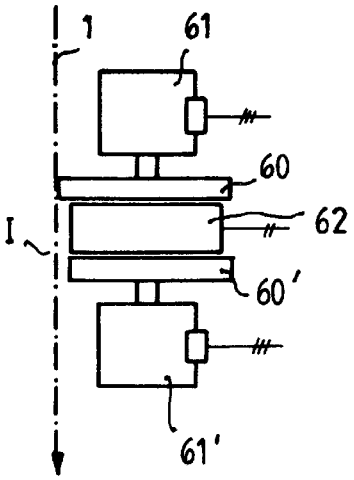
Fig.3
Fig.2
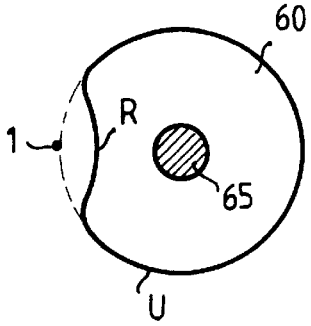
Fig.4
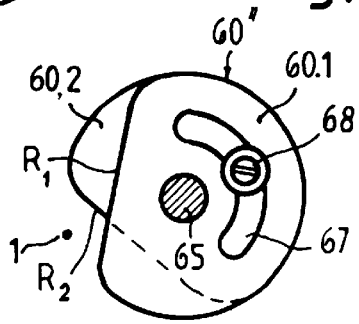

DEVICE FOR PRODUCING THICK AND THIN EFFECTS IN A FILAMENT YARN

REFERENCE TO RELATED APPLICATIONS

This application is a national stage of PCT/DE97/00809 filed 22 Apr. 1997 and based, in turn, on German national application 196 26 032.9 filed Jun. 28, 1996 under the International Convention.

FIELD OF THE INVENTION

The invention relates to a device for the production of thick/thin effects in a filament yarn, which is stretched in at least one stretching zone limited respectively by an inlet filament-engaging mechanism and an outlet filament-discharge mechanism, whereby between the inlet filament-engaging mechanism and the outlet filament-discharge mechanism a heating device in the form of a heating element (20.1) touched by the filament yarn is arranged. Means are privided for the interruption of heat supply.

BACKGROUND OF THE INVENTION

According to one embodiment, in the above-mentioned device (see German Patent 195 29 315) it has been proposed to use a mechanism for lifting the filament yarn from a stationary heating device within the stretching zone, at defined intervals during stretching. The stretching zone is limited by two gallet/transfer roller combinations, between which the mentioned mechanism and the stationary heating device are arranged. The stretching zone can also be limited, at least on one side, by a pair of feeding rollers (with lower/upper rollers).

In the aforementioned construction it can happen that the mechanical arrangement causes the. The mechanical arrangement in this application can cause the filament yarn to vibrate, which results in uncontrollable movements of the filament yarn.

OBJECT OF THE INVENTION

It is the object of the present invention to provide an improved apparatus in which the filament yarn is deflected as little as possible during the heat transfer in both treatment stages (heated and not heated).

SUMMARY OF THE INVENTION

This object is attained in accordance with the invention in that the heating surface of the heating element acting on the filament yarn is the periphery of at least one disk driven about an axis with at least one region whose radius is reduced with respect to the axis. According to the invention it is proposed to move the heating element and not the filament yarn. The disk and the yarn path are so arranged with respect to one another that the filament yarn has a tangential contact with the disk periphery, and this contact does not follow the indentation, i.e. the reduced radius of the disk.

When the filament yarn runs over the circumference of the rotating heated disk, the yarn length touched by the disk is thereby heated and, is stretched, while the yarn length which does not touch the disk in the indentation of the disk remains cold and therefore is not stretched.

This area remains as the thick effect in the filament yarn.

Due to the fact that the yarn has only tangential contact with the disk, its deflection is minimal between the contact with the periphery and the lack of contact in the region with reduced radius, and therefore advantageously no vibration occurs. The ability to reproduce the thin and thick portions and the quality of the effect yarn is improved.

Yarn speed, the rotational speed of the disk and the number of regions with reduced disk radius determine the number of the thick areas along the filament yarn. The length of the recess, i.e. of the area with reduced radius, determines the length of the thick regions in connection with the yarn speed and the rotational speed, as well as the thickness of the disk. Therefore the length of the thick regions can be determined only by changing the length of the regions with reduced radius along the disk periphery, independently of on the number of thick regions along the filament yarn.

Advantageously any such disk can be replaced by disks having a different length of the region with reduced radius along the disk periphery.

In a further embodiment of the invention two disks can be arranged at a distance from one another and for instance can be driven with rotational speeds which do not depend on one another.

Alternately one disk can consist of two or more disk parts which can be rotered with respect to one another as to their respective regions with reduced radius.

In one of the embodiments of the invention the axis of rotation of the disk can be at least approximately parallel to the travel direction of the filament yarn. Alternatively the rotation axis of the disk can lie in a plane which forms an approximately right angle with the travel direction of the yarn.

It is common to all embodiments that the disks can be heated by at least one stationary heating device arranged in immediate proximity thereto, through convection, radiation or induction.

BRIEF DESCRIPTION OF THE DRAWING

The above and other objects, features, and advantages will become more readily apparent from the following description, reference being made to the accompanying drawing in which:

FIG. 1 is a schematic side view of a first embodiment of the invention;

FIG. 2 is a plan view of the disk;

FIG. 3 is another embodiment of the invention in a schematic side view;

FIG. 4 is a plan view of a disk consisting of two disk parts.

SPECIFIC DESCRIPTION

In FIG. 1 a device for producing thick/thin effects in a filament yarn 1 is shown. Two gallet/transfer roller combinations are used, in the form of an inlet filament-engaging mechanism 6 and an outlet filament-discharge mechanism 6', between which the filament yarn 1 is stretched in a stretching zone I. The stretching zone can be also limited at least on one side by a pair of discharge rollers (with upper/lower roller).

In this stretching zone I there is a heating element 20.1, which consists of a disk 60 and a stationary heating device 62 arranged in immediate proximity of the disk. By means of this heating device 62 the disk can be heated by convection and/or radiation.

The disk 60 is driven by a motor 61 via rotary shaft 65.

From FIG. 2 can be seen that the periphery U of the heated disk 60 serves as a heating surface for the filament yarn, whereby the disk 60 is shaped with an area with a reduced radius R with respect to the rotary axle 65. This area R with reduced radius forms a recess in which the filament yarn does not touch the disk periphery so that the yarn remains cold and therefore is not stretched. A thick region thus results in the filament yarn. Stretching takes place while the filament yarn runs over the periphery U of the turning heated disk 60 and is heated.

The disk 60 can also have several recesses R and recesses of various length in peripheral direction, which can be distributed at random over the disk periphery. Thereby any desired number, length and distribution of thick regions along the filament yarn can be achieved.

In the embodiment according to FIG. 1 and 2 only one disk 60 is used. Corresponding to the embodiment according to FIG. 3, two disks 60 and 60' can be arranged at a distance from each other. It is thus possible disks 60 and 60' with different rotational speeds, namely by motor 61 and 61'.

The two disks 60 and 60' can also be placed on a common shaft with recesses R turned in different directions. The preferred embodiment is the one represented in the drawing with separate drives for the disks, because a higher randomization in the distribution of the thick regions can then be achieved.

It is thus possible to achieve a desired random distribution of the thick regions along the filament due to different and also changing rotational speeds of the two disks 60 and 60'. A heating device 62 is located here between the disks 60 and 60' and heats both of them. Of course it also possible to provide separate heating devices for each disk. Each of the disks 60 and 60' can have an analogous configuration with the embodiment according to FIG. 2, namely for instance with mutually rotated areas R wherein the filament yarn is not touched.

A further embodiment of the invention is shown in FIG. 4. Here a disk 60" is used which consist of two disk parts 60.1 and 60.2 whose respective areas with reduced radius $R_1$ and $R_2$ can be twisted with respect to each other. Both disk parts 60.1 and 60.2 have a common rotary shaft 65. Further each is provided with a long hole 67 which is traversed by a clamping screw 68. This way it is possible to turn the two disk parts 60.1 and 60.2 with respect to each other and to correspondingly change the position of the areas with reduced radius $R_1$ and $R_2$.

Thereby it is possible to select the length of the produced thick regions, just like in the case of different rotational speeds of the disks 60, 60'.

In the embodiments according to FIG. 1 to 4 the rotation axis 65 of the disks 60, respectively 60' and 60" is at least approximately parallel to the travel direction of the filament yarn. In an embodiment which is not closer described it is also possible to position the rotation axis of the mentioned disk in a plane which forms an approximately right angle yarn.

It is common to all embodiments that the yarn speed, the rotational speed and the number of the recessed areas along the disk periphery determine the number of thick regions along the filament yarn. Furthermore the length of the recesses along the disk periphery determines the length of the thick regions, in combination with the yarn speed and the rotational speed, as well as the thickness of the disk. Due to fact that the filament yarn 1 touches the periphery of the respective disk only tangentially, its deflection due to contact with the periphery U, respectively the noncontact with the respective recesses, is minimized and does not trigger vibrations.

The rotational speed of disk to or disks can be changed at random, in order to achieve a random distribution of the thick regions along the filament yarn. Furthermore it is possible that the disk or the disks be provided with more than one area with reduced radius; several such areas can have different lengths and/or be distributed randomly in peripheral direction.

Regarding the design of the heating device it is also possible to heat the disk itself directly and in this way to eliminate the heating device 62.

I claim:

1. A device for producing thick/thin effects in a filament yarn, comprising:

an inlet filament-engaging mechanism;

an outlet filament-engaging mechanism spaced from said inlet filament-engaging mechanism to delimit a stretching zone between said mechanisms, a filament yarn being advanced by said mechanisms through said zone and being stretched between said mechanisms; and a heating element acting on said filament yarn in said zone and for interrupting heating thereof, said heating element being at least one disk having a periphery engaging the filament yarn, driven by a rotary shaft and formed with at least one region with reduced radius with respect to an axis of rotation of the disk, and means for heating the at least one disk.

2. The device defined in claim 1 wherein said heating element includes two disks each having a periphery contacting said filament yarn and at least one said region with reduced radius.

3. The device defined in claim 2, further comprising means for driving said disks independently with different rotational speeds.

4. The device defined in claim 1 in which at least one of said disks comprises two relatively rotatable disk parts twisted with respect to one another to offset respective regions with reduced radius.

5. The device defined in claim 1 wherein said means for heating includes a stationary convection heater in an immediate proximity of said disk.

6. The device defined in claim 1 wherein said means for heating includes a stationary radiant heater in an immediate proximity of said disk.

7. The device defined in claim 1 wherein said means for heating includes a stationary induction heater in an immediate proximity of said disk.

8. The device defined in claim 1, further comprising means connected with said disk for changing a rotational speed thereof.

9. The device defined in claim 1 wherein said disk is provided with a plurality of regions of reduced radius around a periphery of said disk.

10. The device defined in claim 9 wherein said regions are of different circumferential length.

11. The device defined in claim 1 wherein a multiplicity of regions of reduced radius are randomly distributed around a periphery of said disk.

12. The device defined in claim 1 wherein a plurality of said disks are provided and a multiplicity of said regions of reduced radius are randomly distributed around peripheries of said disks.

* * * * *